US005741186A

United States Patent [19]

Tatsuno

[11] Patent Number: 5,741,186

[45] Date of Patent: Apr. 21, 1998

[54] IMPULSE TORQUE GENERATOR FOR A HYDRAULIC POWER WRENCH

[75] Inventor: Koji Tatsuno, Osaka, Japan

[73] Assignee: URYU Seisaku, Ltd., Osaka, Japan

[21] Appl. No.: 418,464

[22] Filed: Apr. 7, 1995

[30] Foreign Application Priority Data

Apr. 8, 1994 [JP] Japan ..... 6-095753

[51] Int. Cl.[6] ..... B25B 21/02

[52] U.S. Cl. ..... 464/25; 81/463

[58] Field of Search ..... 464/25; 81/463, 81/464, 465, 466; 173/93, 93.5

[56] References Cited

U.S. PATENT DOCUMENTS

| | | | |
|---|---|---|---|
| 2,343,596 | 3/1944 | Van Sittert et al. | 173/93.5 |
| 3,196,636 | 7/1965 | Piatt et al. | 173/93 X |
| 3,214,941 | 11/1965 | Shulters | 173/93 X |
| 4,785,693 | 11/1988 | Minamiyama et al. | 81/465 |
| 4,836,296 | 6/1989 | Biek | 81/463 X |
| 4,854,916 | 8/1989 | Schoeps et al. | 464/25 |
| 4,920,836 | 5/1990 | Sugimoto et al. | 81/463 |

FOREIGN PATENT DOCUMENTS

| | | | |
|---|---|---|---|
| 1315283 | 6/1987 | U.S.S.R. | 81/463 |
| 2240500 | 8/1991 | United Kingdom | 81/464 |

*Primary Examiner*—Daniel P. Stodola
*Assistant Examiner*—William A. Rivera
*Attorney, Agent, or Firm*—Wenderoth, Lind & Ponack

[57] ABSTRACT

An impulse torque generator, for a hydraulic impulse torque wrench, includes a liner driven by a rotor. The liner has an inner cavity with at least two pairs of sealing surfaces around its inner peripheral surface. A main shaft extends coaxially through the liner and includes at least two projections. Also, at least two driving blades are provided for generating an impulse torque on the main shaft by abutting the projections of the main shaft.

5 Claims, 15 Drawing Sheets

IMPULSE TORQUE GENERATOR FOR A HYDRAULIC POWER WRENCH

BACKGROUND OF THE INVENTION

The invention relates to a hydraulic impulse torque generator for a power driven torque wrench.

Power driven wrenches have been developed and are widely used because the noise and the vibration during operation are rather small.

FIG. 21 shows an example of this type of hydraulic impulse wrench which includes a main valve 2 for starting and stopping a supply of compressed air, a direction switch valve 3 for selecting the direction of revolution, and a rotor 4 which is driven by compressed air supplied through the main and switch valves. An impulse torque generator 5, which converts rotational output torque into an impulse torque, is mounted inside a front case 6 which projects from the main body of the hydraulic impulse torque wrench 1. The impulse torque generator 5 includes a liner 8 disposed inside a liner case 7, a main shaft 9 having one or more slots on its surface which are coaxially mounted within the liner 8, and blades disposed along the slots of the main shaft 9. The blades are radially urged outwardly by springs into contact with the inner surface of the liner thereby forming a seal between the liner 8 and the main shaft 9. The liner 8 has an output adjusting mechanism 10 for adjusting the strength of impact torque. An impact torque is generated on the main shaft 9 when the blades reach the seal points inside the liner 8 while the liner is driven by the rotor 4.

In the impact torque wrench of the prior art, frictional resistance between the blades and the surface of the inner surface of the liner 8 causes a comparatively large energy loss because the blades, disposed in the slots of the main shaft 9, are always urged radially by the springs into contact with the inner surface of the liner 8, and the frictional heat causes a viscosity change of the hydraulic oil in the liner 8, and consequently, the output of the wrench fluctuates.

The diameter of the main shaft 9 must be designed relatively large in order to obtain sufficient strength. Therefore, it is difficult to manufacture a compact impulse torque wrench because of the slots for mounting the blades on the main shaft 9 and the holes for mounting the springs. In addition, the structure of the tool becomes complex and the durability of the tool is insufficient because the springs are likely to be damaged or destroyed.

SUMMARY OF THE INVENTION

An objective of this invention is to provide an impulse torque generator which is more energy efficient by decreasing the energy lost due to frictional resistance between the blades and the inner surface of the liner. The impulse torque generator of the present invention results in little rise of working fluid temperature, and is a compact construction with excellent durability. The blade biasing springs, which are essential in a conventional impulse torque generator, are not necessary in the present invention.

The objective of this invention is accomplished by an impulse torque generator for a hydraulic power driven wrench including a liner, driven by a rotor, having an inner cavity and at least four or at least two pairs (2n) of seal surfaces around its inner surface. A main shaft, having at least two (n) projections on its surface, mounted coaxially within the liner and at least two (n) driving blades, with seal surfaces at both longitudinal edge portions or ends, are provided for generating an impulse torque on the main shaft by abutting the projections of the main shaft. The variable n is an integer greater than 2.

The seal surface is arranged symmetrically with respect the center of revolution at an angle of 360/n degrees, so that n impacts are generated on the main shaft with each revolution of the liner.

Also, in the second embodiment, the seal surfaces are arranged symmetrically with respect to the center of revolution at an angle of 360/n degrees, and a groove is disposed at the inner side of the liner cover and the side of the driving blades which contact the liner thereby releasing hydraulic oil pressure and generating one impulse with each revolution of the liner.

Also, in the third embodiment, the impulse generator includes a pair of sealing surfaces which are not symmetrically arranged so that only one impulse is generated on the main shaft with each revolution of the liner.

Also, in a fourth embodiment, the sealing surfaces of the impulse generator are arranged symmetrically at an angle of 360/n degrees, and guide grooves are eccentrically disposed in an inner surface of the liner cover. Pins are disposed at the side of the driving blades and engage the guide grooves thereby generating one impulse on the main shaft with each revolution of the liner.

As the liner is driven by the rotor, the sealing surfaces on the liner and the sealing surface at both ends of the driving blades meet each other, and an impulse is generated on the main shaft of the machine. Therefore, the springs of the conventional torque wrench are no longer necessary. Further in the present invention, high energy efficiency is accomplished, and a steady output of the impulse is obtained with only a small rise in hydraulic oil temperature. Also, it is possible to provide a compact impulse torque wrench which is simple in structure and high in durability.

Further, as the liner is driven by the rotor, the n pairs of seal surfaces, disposed inside the liner at an angle of 360/n degrees, and the seal surface at both ends of the driving blades meet n times during one revolution of the liner, and therefore n impulses are generated with each revolution of the liner.

Further, as the liner is driven by the rotor, the n pairs of seal surfaces, disposed inside the liner at an angle of 360/n degrees, and the seal surfaces at both ends of the driving blades meet n times with one revolution of the liner, but the high pressure of the hydraulic oil is released through holes disposed in the driving blades, and therefore only one large impulse is generated with each revolution of the liner.

Further, as the liner is driven by the rotor, the n pairs of seal surfaces, which are not symmetrically disposed inside the liner at an angle of 360/n degrees, and the sealing surfaces at both ends of the driving blades meet one time during one revolution of the liner. Therefore, only one large impulse is generated with each revolution of the liner.

Further, as the liner is driven by the rotor, the n pairs of sealing surfaces, disposed inside the liner at an angle of 360/n degrees, and sealing surfaces at both ends of the driving blades meet one time during one revolution of the liner by constraining the movement of the driving blades with pins on an end of the driving blades disposed in guide grooves on the liner covers. Therefore, only one impulse is generated with each revolution of the liner.

BRIEF DESCRIPTION OF THE DRAWINGS

FIG. 1(*a*) is an elevation view of the impulse generator and FIG. 1(*b*) is a cross sectional view taken along line I—I of FIG. 1(*a*).

DETAILED DESCRIPTION OF THE INVENTION

The present invention will now be further explained with reference to the accompanying drawings.

FIGS. 1 to 6 illustrate the first embodiment of a hydraulic impulse torque generator.

Figure 21:
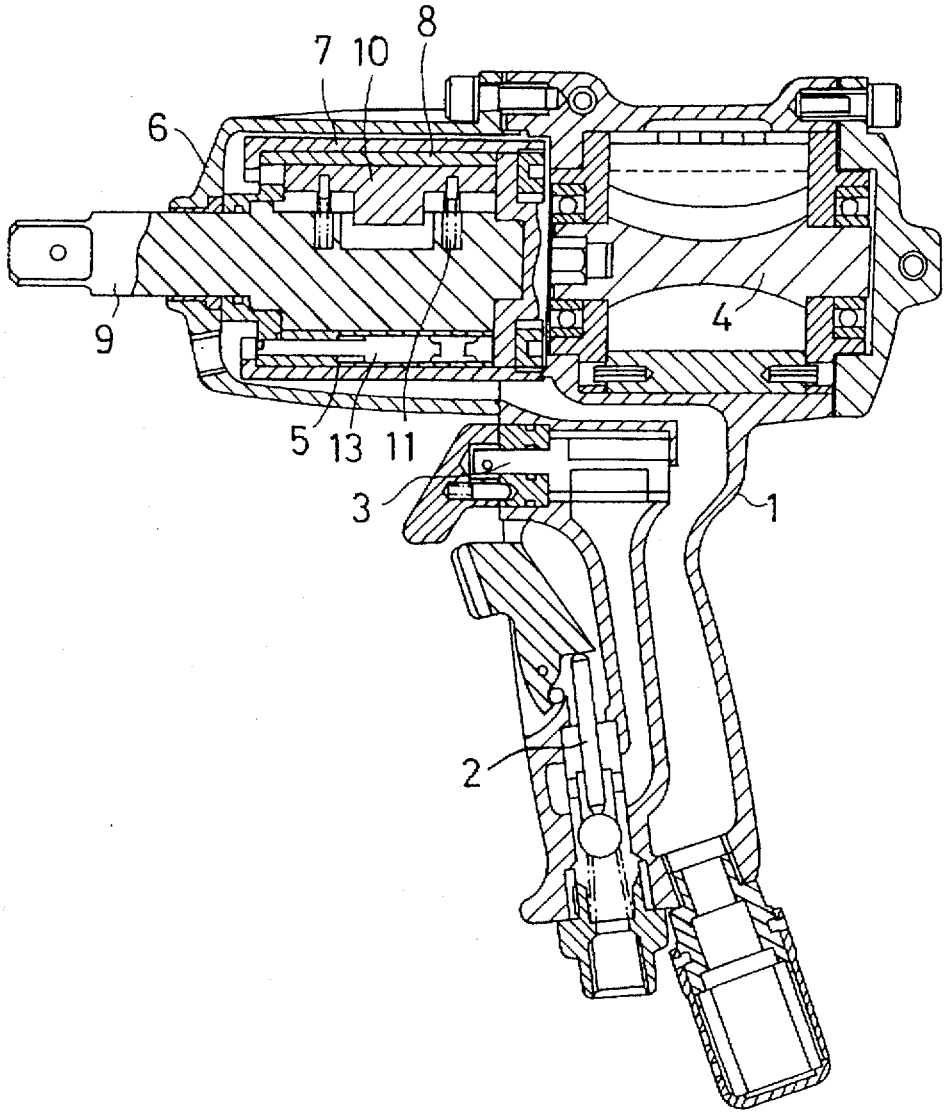
FIG. 21 PRIOR ART
FIG. 21 shows an example of a prior art impulse torque wrench.

The basic structure of the impulse torque generator of the present invention is the same as that of the prior art impulse torque generator shown in FIG. 21. The impulse torque wrench of the present invention includes a main valve 2 for starting and stopping a supply of compressed air, and a direction switch valve 3 for selecting the direction of the rotation. A rotor 4 is driven by compressed air supplied through the valves 2,3. An impulse torque generator, which converts rotational output torque into impulse torque is mounted inside a front case 6 which projects from a main body of the hydraulic impulse torque wrench 1.

An impulse torque generator 5 of the first embodiment includes a liner 11 filled with hydraulic oil and disposed inside a liner case 7, and a main shaft 9 coaxially mounted within the liner 11.

The liner 11 has an oval profile internal cavity section and is provided with at least four or two pairs of sealing surfaces 11*a*, 11*b* which gradually project from the inner surface of the liner and are arranged symmetrically with respect to a center of revolution at an angle of 180 degrees.

The liner 11 is inserted inside the liner case 7 and both ends of the liner case 7 are closed with an upper cover 12 and a lower cover 13. The covers are secured to the liner 11 with knock-pins 17 which are inserted into pin holes 12*a*, 13*a*. The liner 11 and the covers 12, 13 are thereby rotatable as one solid body. Further, the upper cover 12 is covered with liner case cover 7*a* to fix the cover in an axial direction and to seal the hydraulic oil inside of liner 11.

The main shaft 9 is mounted inside the liner 11 and has two smooth shaped projections 15*a*, 15*b* symmetrically disposed with respect to the revolution center at an angle of 180 degrees. A radial length and an axial length of the two projections 15*a*, 15*b* are smaller than that of the liner thereby forming hydraulic oil passages at both ends of the liner and between the top of the projections and the inner surface of the liner.

Two driving blades 14*a*, 14*b*, which have a smoothly contoured triangle shape, are inserted inside the liner cavity and are separated by the projections 15*a*, 15*b* of the main shaft.

The axial length of each driving blade is the same as that of inner cavity of the liner so that the driving blades contact the upper cover and the lower cover at both ends. Also, sealing surfaces 11*a*, 11*b* are designed so that they contact sealing surfaces of the driving blades 14*a*, 14*b* and form seals two times with each revolution of the liner 11.

A passage 16 is disposed in an outer surface of the liner for communicating with low pressure chambers L which are formed inside the liner cavity by the driving blades 14*a*, 14*b*. An output adjusting mechanism is disposed in the liner parallel to the axis of the liner. This mechanism is a well known mechanism which may include for example ports 10*a*, 10*b* connecting high pressure chambers H, which are formed inside the liner cavity by the driving blades 14*a*, 14*b*, and an output adjusting valve 10*c* which is screwed into a screw hole 13*b* disposed in the lower cover 13.

In this embodiment, the impulse torque generator has four sealing surfaces which are two pairs of sealing surfaces disposed on an internal peripheral surface of the liner, two radially extending projections 15*a*, 15*b*, and two driving blades 14*a*, 14*b*. The number of sealing surfaces is selected depending on the desired number of impulses generated during each revolution of the liner. For instance, if n impulses are desired during one revolution of the liner, then the number of the seal surfaces inside the liner will be 2n (n pairs), and there will be n projections radially projecting from the main shaft and n driving blades.

Now, the process of generating an impulse is explained in more detail with reference to FIGS. 6(*a*)–6(*d*).

The rotor 4 is rotated by introducing compressed air into the rotor 4 of the main body by opening the main valve and the switch valve. The revolution power is transmitted to the liner 11. As the liner rotates, the position of the inside the liner case 7 changes as indicated in FIGS. 6 (*a*)–(*b*)–(*c*)–(*d*)–(*a*). FIG. 6(*a*) indicates the position where no impulse is generated on the main shaft. FIGS. 6(*b*),(*c*),(*d*) indicates the positions where the liner 11 rotates through an angle of 90 degrees respectively.

An impulse is generated, as indicated in FIG. 6(*b*) and FIG. 6(*d*), when the seal surfaces 11*a*, 11*b* and the seal surfaces of the driving blades meet together and the inner cavity of the liner 11 is divided into four chambers. The instant an impulse torque is generated on the main shaft, the volume of high pressure chamber H decreases and the volume of low pressure chamber L increases because of the shape of the inner surface of the liner. Then the high pressure chamber is changed to a low pressure chamber and vise versa. That is, as the rotor drives the liner 11, seal surfaces 11*a*, 11*b* of the liner meet the sealing surfaces of the driving blades 14*a*, 14*b*. Each chamber becomes a high pressure chamber or a low pressure chamber, the driving blades 14*a*, 14*b* are pushed toward the low pressure chamber, then the rotational power of the liner 11 is exerted on projections 15*a*, 15*b* of the main shaft 9 through the driving blades 14*a*, 14*b* and provides an impulse on the main shaft 9, which is two impulses generated during each revolution of the liner.

On the other hand, as indicated in FIG. 6(*a*) and (*c*), as the liner rotates and seal surfaces 11*a*, 11*b* of the liner and the sealing surfaces of the driving blades meet, each chamber becomes high pressure or low pressure chamber for an instant. The driving blades are pushed toward the low pressure chamber, then the seals at the sealing surfaces are broken and hydraulic compressed oil in the high pressure chamber will flow out through gaps between the seal surfaces into the low pressure chamber, and therefore no impulse is generated on the main shaft 9.

If the rotor is driven in a reverse direction, the interior surface of the liner case will change in the reverse direction of FIG. 6, that is, the inside surface position changes as 6(*d*)–(*c*)–(*b*)–(*a*)–(*d*) and a reverse direction impulse is generated.

A second embodiment of the present invention is shown in FIGS. 7 to 12.

The basic structure of the second embodiment is the same as the first embodiment explained before.

An impulse generator, filled with hydraulic oil, is disposed inside a liner case 7, and a main shaft 9 is coaxially mounted within the center of a liner 21.

The liner 21 has an oval profile internal cavity section and two pairs or 4 sealing surfaces 21*a*, 21*b* project from the inner surface of the liner and are spaced symmetrically with respect to the center of the revolution by an angle of 180 degrees.

The cylindrical liner 21 is inserted inside the liner case 7 and both ends of the liner case 7 are covered with an upper cover 22 and a lower cover 23. The covers 22, 23 are secured to the liner 21 by means of knock-pins 27 inserted into pin holes 22*a*, 23*a*. The covers 22, 23 and the liner 21 are thereby rotatable as a solid body. Further, the upper cover 22 is covered with liner case cover 7*a* to fix the cover along an axial direction and to seal the hydraulic oil inside of the liner 21.

Grooves 28*a*, 28*b* are provided in the surfaces of the upper cover 22 and the lower cover 23 for releasing the pressure of the hydraulic oil.

A main shaft 9 is mounted inside the liner 21 and has two projections 25*a*, 25*b*. The projections have smooth contours and are symmetrically disposed with respect to the center of revolution by an angle of 180 degrees. The radial length and the axial length of the two projections 25*a*, 25*b* are smaller than that of the liner and thereby form hydraulic oil passages at both ends of the liner and between the top of the projections and the inner surface of the liner.

Two driving blades 24*a*, 24*b*, are inserted inside the liner 21 cavity and are separated by projections 25*a*, 25*b* of the main shaft. The blades 24*a*, 24*b* have a smoothly contoured triangle shape.

The axial length of the driving blades is same as that of the inner cavity of the liner so that the driving blades contact the upper cover and the lower cover at both ends. Grooves 29*a*, 29*b* are provided in the surfaces of the driving blades 24*a*, 24*b* for releasing the pressure of the hydraulic oil. The sealing surfaces 21*a*, 21*b* and the sealing surfaces of the driving blades 24*a*, 24*b* meet and contact each other to form seals two times during each revolution of the liner 21. However, when the grooves 28*a*, 28*b* on the upper cover 22 and the lower cover 23 communicate with the grooves 29*a*, 29*b* in the side of the driving blades 24*a*, 24*b*, hydraulic oil is released from a high pressure chamber to a low pressure chamber, and consequently only one impulse is generated on the main shaft 9 with each revolution of the liner.

In the illustrated embodiment, the grooves 28*a*, 28*b* are disposed on both of the upper and the lower cover, but a groove in only one of the covers will suffice. A groove for releasing the hydraulic oil pressure would be disposed on the corresponding side of the driving blades 24*a*, 24*b*.

A passage 26 is disposed in an outer surface of the liner 21 and communicates with low pressure chambers L which are formed inside the liner cavity by the driving blades 24*a*, 24*b*. An output adjusting mechanism is disposed in the liner parallel to the axis of the liner 21. This mechanism is well known and, for example, may comprise ports 10*a*, 10*b* which connect high pressure chambers H formed inside the liner cavity by the driving blades 24*a*, 24*b* and an output adjusting valve 10*c* screwed into a screw hole 23*b* disposed in the lower cover 23.

In this embodiment, the impulse torque generator has 4 sealing surfaces 21*a*, 21*b*, which are two pairs of sealing surfaces disposed on the internal peripheral surface of the liner 21, two projections 25*a*, 25*b* radially projecting from the main shaft 9, and two driving blades 24*a*, 24*b*. However, the number of sealing surfaces is not restricted to this number. The number of sealing surfaces may be selected depending on the desired strength of the impulse generated during each revolution of the liner. For instance, if more than n (n is greater than 3) pairs of seal surfaces are provided on the inner surface of the liner, then n projections will radially project from the main shaft, and n driving blades are necessary, and consequently a greater impulse is generated.

Now, a process of generation of an impulse is explained in more detail with reference to FIGS. 12(*a*)–12(*d*).

The rotor 4 is rotated by introducing compressed air into the rotor 4 of the main body by opening the main valve 2 and the switch valve 3. The revolution power is transmitted to the liner 31. As the liner rotates, the position of the inside of the liner case 7 changes as indicated in FIGS. 12 (*a*)–(*b*)–(*c*)–(*d*)–(*a*). FIG. 12(*a*) indicates the position where no impulse is generated on the main shaft 9. FIGS. 12(*b*), (*c*), and (*d*) indicates the liner 31 rotated through an angle of 90 degrees, respectively.

An impulse is generated as indicated in FIG. 12(*b*) when the sealing surfaces 21*a*, 21*b* and the sealing surfaces of the driving blades 24*a*, 24*b* meet, and the inner cavity of the liner 21 is divided into four chambers. The instant an impulse torque is generated on the main shaft 9 the volume of a high pressure chamber H decreases and a volume of a low pressure chamber L increases because of the shape of the inner cavity of the liner, and then the high pressure chamber changes to a low pressure chamber and vise versa. That is, as the rotor 4 drives the liner 21, seal surfaces 21*a*, 21*b* of the liner meet the sealing surfaces of the driving blade 24*a*, 24*b* and each chamber alternately becomes a high pressure chamber or a low pressure chamber. The driving blades 24*a*, 24*b* are pushed toward the low pressure chamber, the sealing surfaces have formed a sealed chamber and the rotational power of the liner 21 is exerted on projections 25*a*, 25*b* of the main shaft 9 through the driving blades 24*a*, 24*b*. An impulse is intermittently provided on the main shaft 9, which is one impulse with each revolution of the liner.

In the position shown in FIG. 12(*d*), though the seal surfaces 21*a*, 21*b* of the liner 21 and the seal surfaces of the driving blades meet, hydraulic oil in the high pressure chamber H will be released out through the grooves 28*a*, 28*b* disposed in the upper and lower covers, and the grooves 29*a*, 29*b* disposed on the side of the driving blades 24*a*, 24*b*, and therefore, the inner cavity is not sealed and no impulse is generated on the main shaft 9.

On the other hand, as indicated in FIG. 12(*a*) and (*c*), as the liner 21 rotates and sealing surfaces 21*a*, 21*b* of the liner and the sealing surfaces of the driving blades meet, each chamber becomes a high pressure or a low pressure chamber for an instant, and the driving blades are pushed toward the low pressure chamber and thus seals formed between the sealing surfaces are broken and hydraulic compressed oil in the high pressure chamber will flow out through gaps between the seal surfaces into a low pressure chamber, and therefore no impulse is generated.

Further, a part of the hydraulic oil in the high pressure chamber flows out to the lower chamber through grooves 29*a*, 29*b* in the driving blades 24*a*, 24*b* and the grooves on the upper and the lower cover 22, 23 of the liner 2.

If the rotor 4 is driven in a reverse direction, the inside surface of the liner case 7 will change in the reverse direction of FIG. 12, that is, the position of the inside of the liner changes as shown in FIGS. 12(*d*)(*c*)–(*b*)–(*a*)–(*d*), and a reverse direction impulse on the main shaft 9 is generated.

Figure 1B:
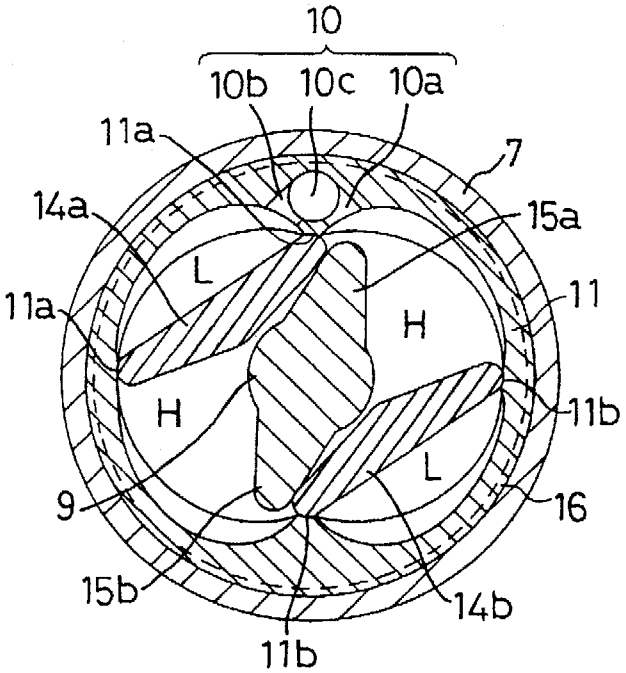
FIGS. 1(*a*)–1(*b*) show a first embodiment of the impulse torque generator of the present invention.
Figure 1A:
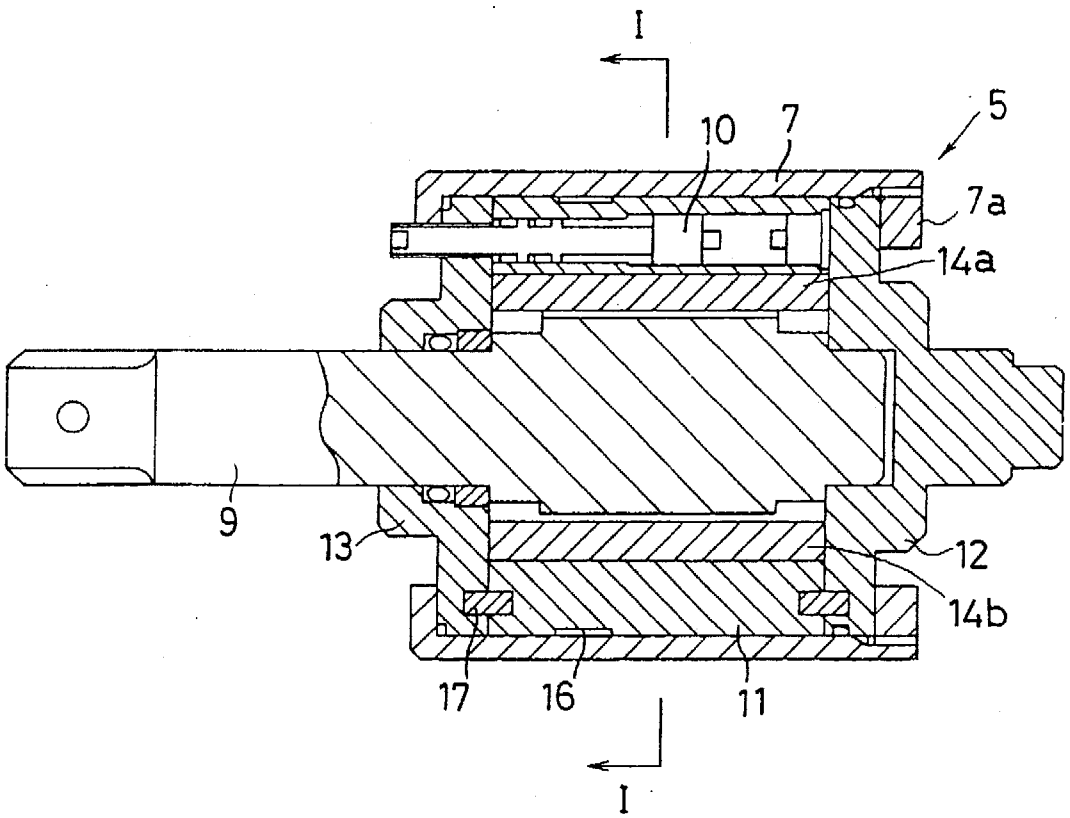
Figure 2A:
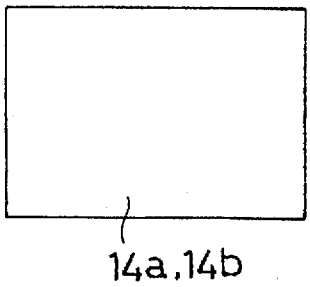
FIGS. 2(*a*)–2(*b*) show a driving blade of the impulse generator.
Figure 2B:
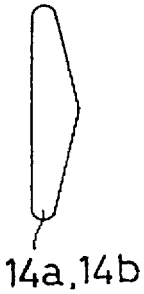
Figure 3A:
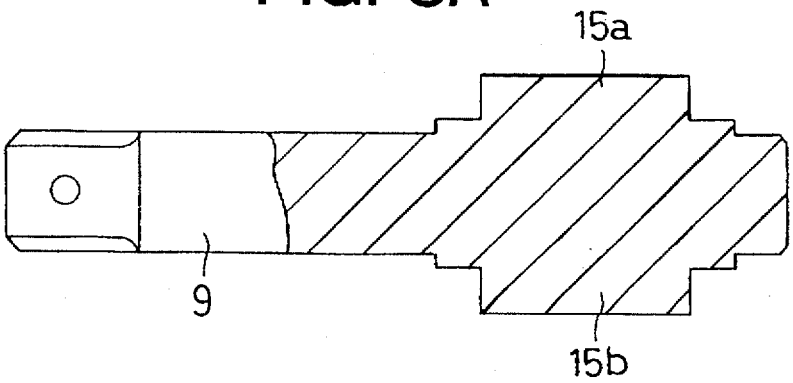
FIGS. 3(*a*)–3(*b*) show an embodiment of a main shaft of the impulse generator.
Figure 3B:
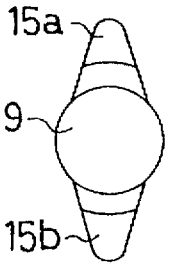
Figure 4A:
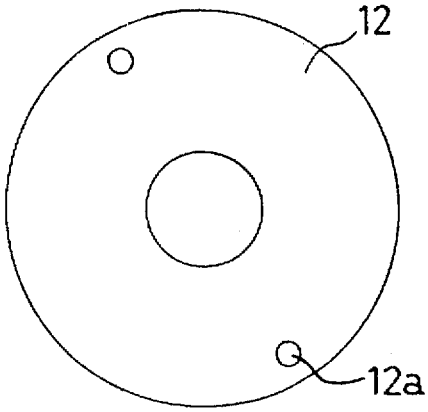
FIGS. 4(*a*)–4(*b*) show an upper cover of the liner of the impulse generator.
Figure 4B:
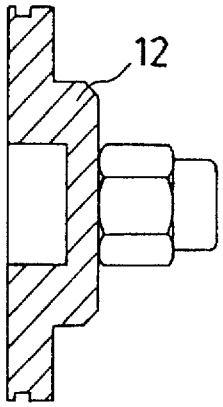
Figure 5A:
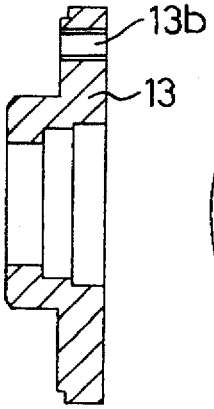
FIGS. 5(*a*)–5(*b*) show a lower cover of the liner of the impulse generator.
Figure 5B:
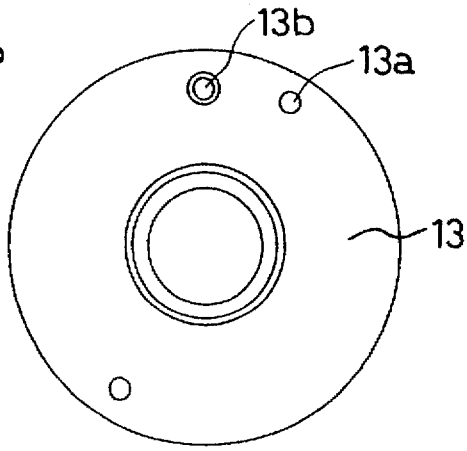
Figure 6A:
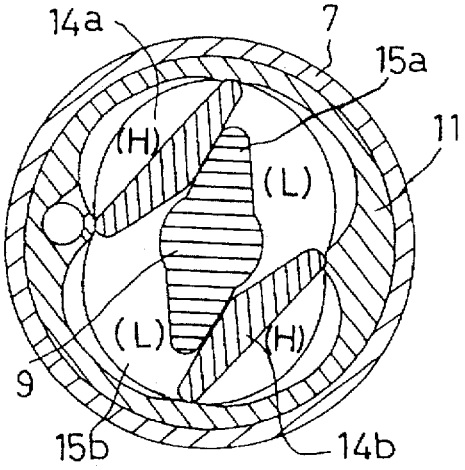
FIGS. 6(*a*)–6(*d*) show an impulse generating process of the impulse generator of the present invention.
Figure 6B:
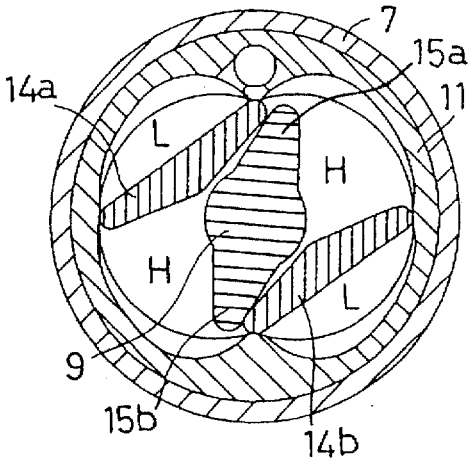
Figure 6C:
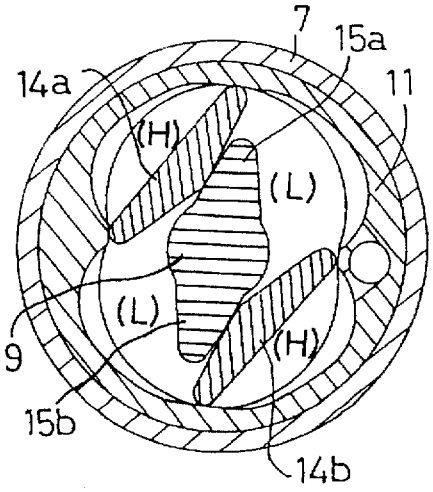
Figure 6D:
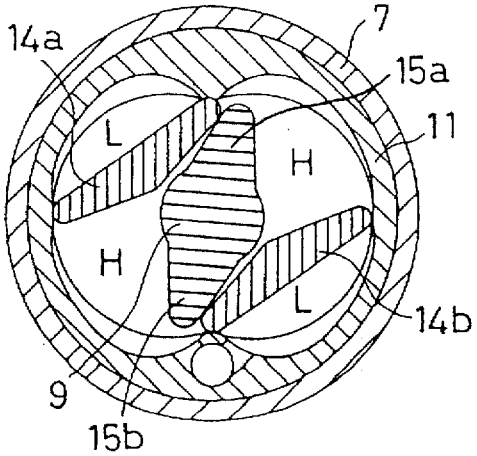
Figure 7B:
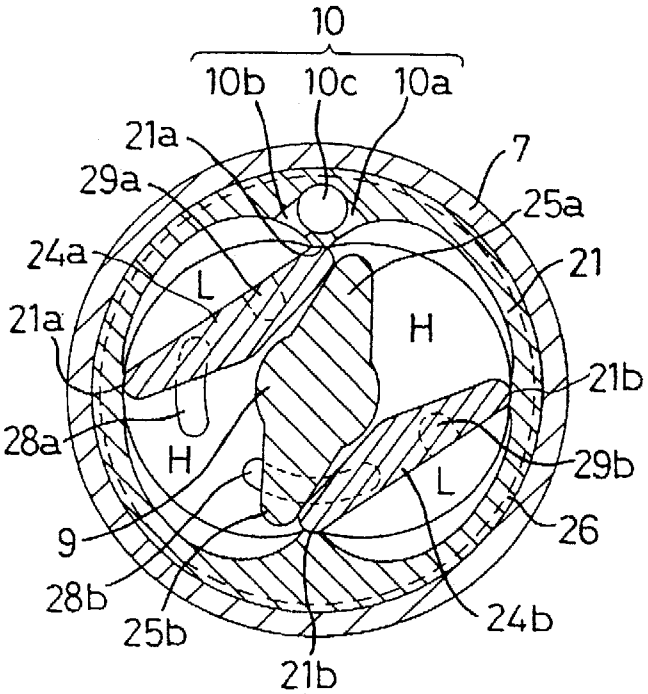
FIGS. 7(*a*)–7(*b*) show a second embodiment of the impulse torque generator of the present invention, FIG. 7(*a*) is an elevation view of the impulse generator and FIG. 7(*b*) is a cross sectional view taken along line II—II of FIG. 7(*a*).
Figure 7A:
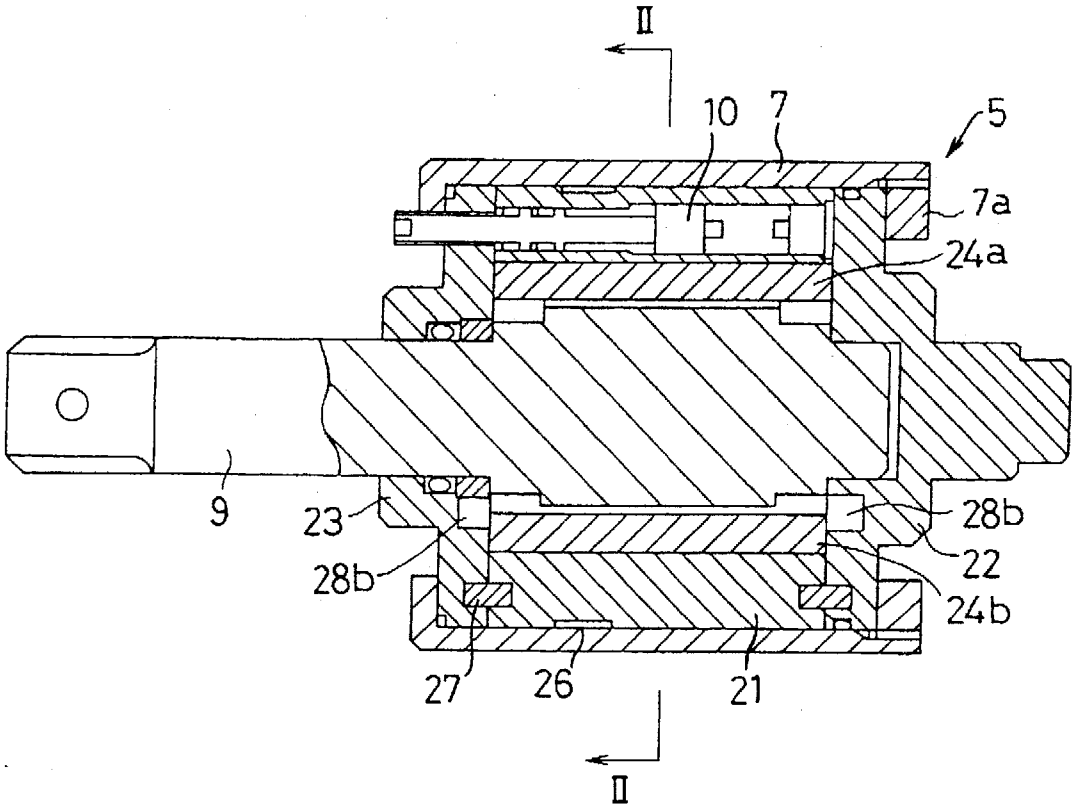
Figure 8A:
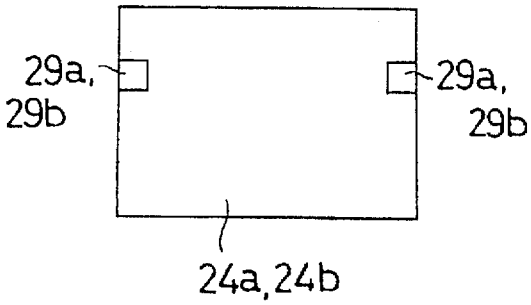
FIGS. 8(*a*)–8(*b*) show a driving blade of the impulse generator of the second embodiment.
Figure 8B:
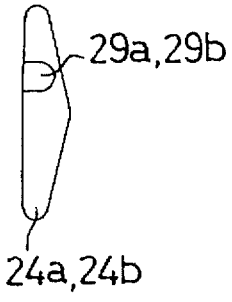
Figure 9A:
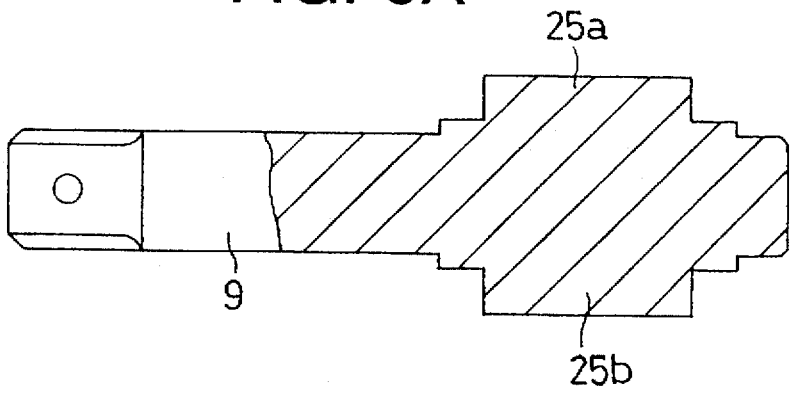
FIGS. 9(*a*)–9(*b*) show a main shaft of the impulse generator of the second embodiment.
Figure 9B:
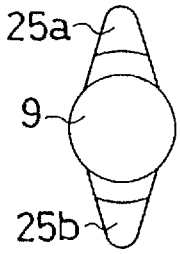
Figure 10A:
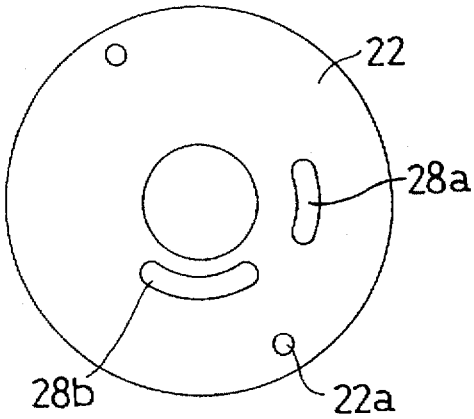
FIGS. 10(*a*)–10(*b*) show an upper cover of the liner of the impulse generator of the second embodiment.
Figure 10B:
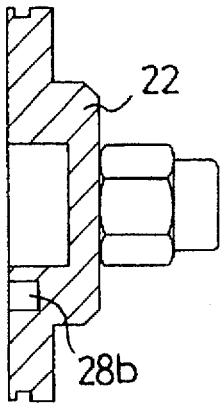
Figure 11A:
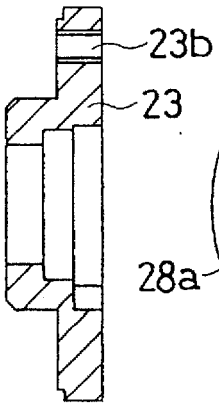
FIGS. 11(*a*)–11(*b*) show a lower cover of the liner of the impulse generator of the second embodiment.
Figure 11B:
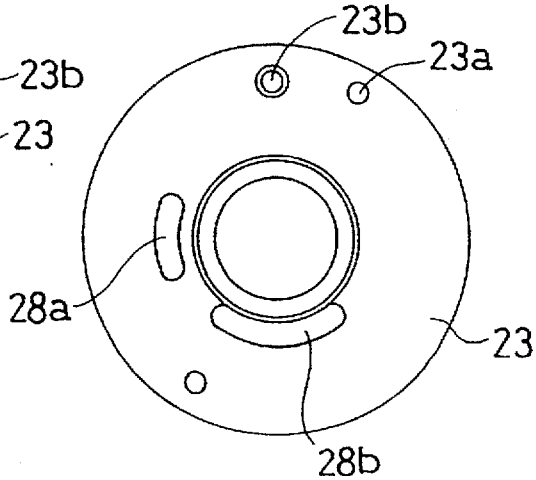
Figure 12A:
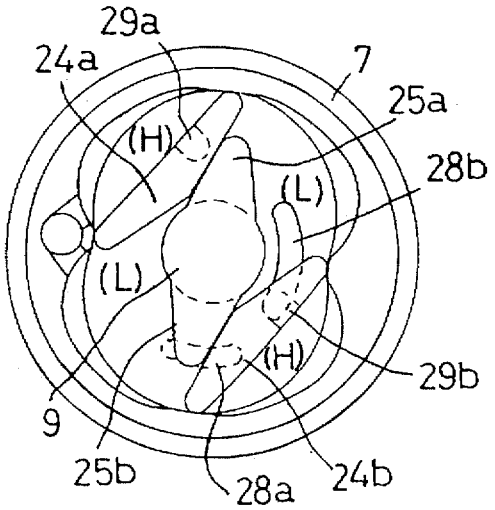
FIGS. 12(*a*)–12(*d*) show an impulse generating process of the impulse generator of the second embodiment.
Figure 12B:
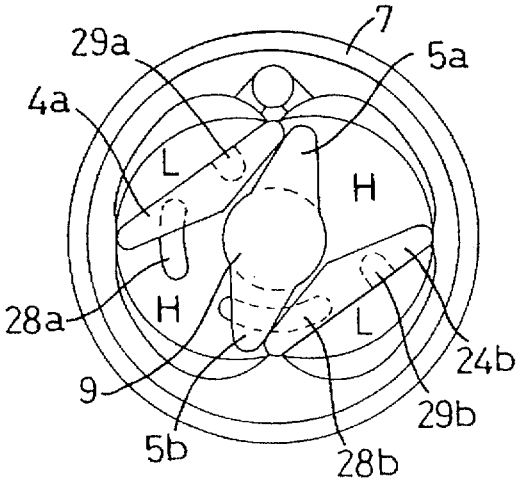
Figure 12C:
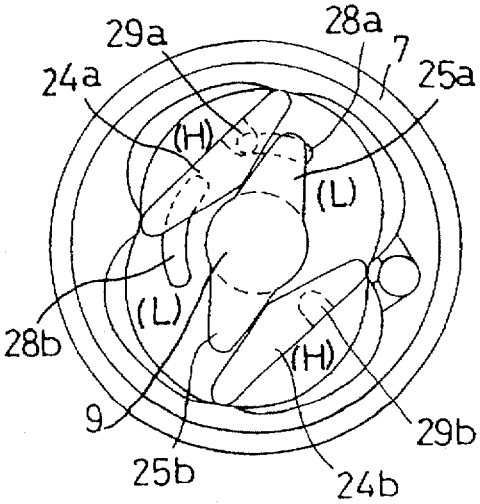
Figure 12D:
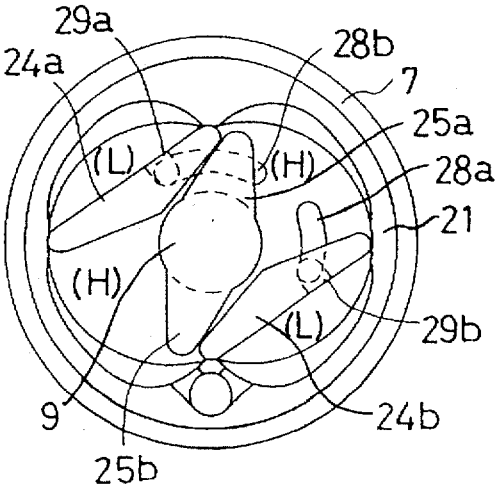
Figure 13B:
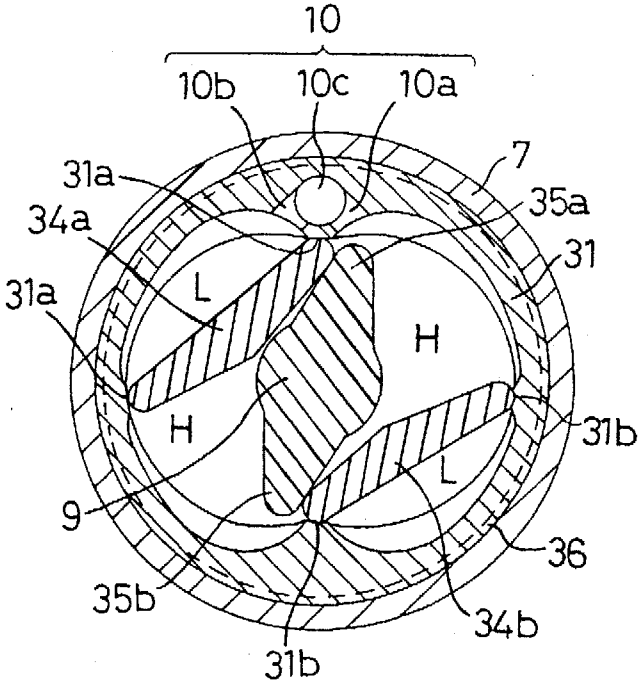
FIGS. 13(*a*)–13(*b*) show a third embodiment of the impulse torque generator of this invention, FIG. 13(*a*) is an elevation view of the impulse generator and FIG. 13(*b*) is a cross sectional view taken along line III—III of FIG. 13(*a*).
Figure 13A:
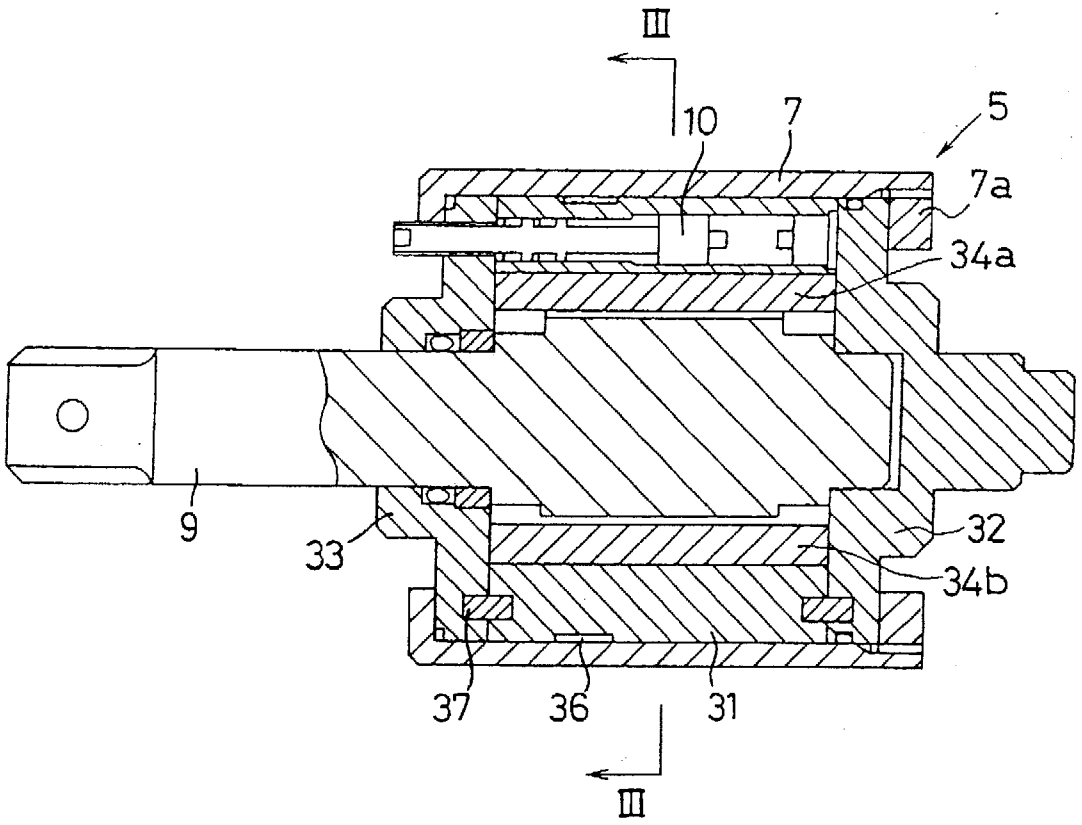
Figure 14A:
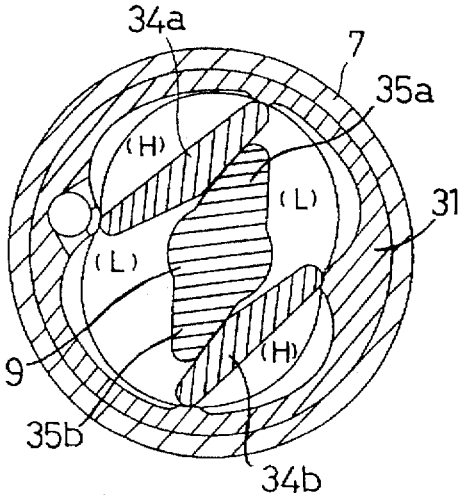
FIGS. 14(*a*)–14(*d*) show an impulse generating process of the impulse generator of the third embodiment.
Figure 14B:
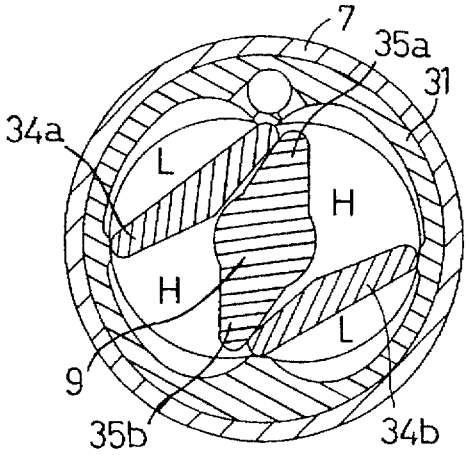
Figure 14D:
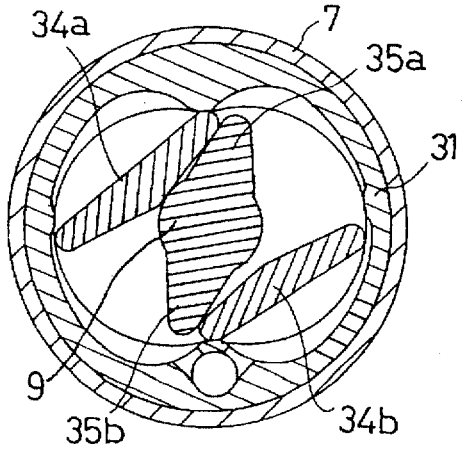
Figure 14C:
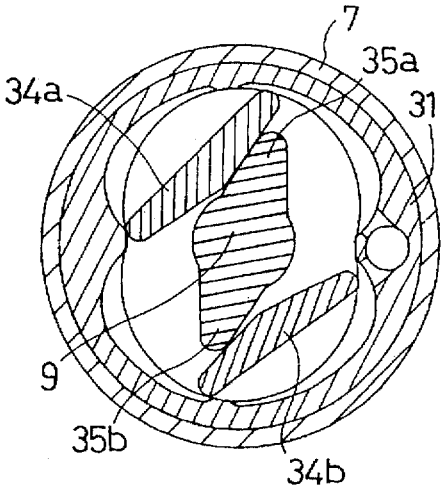
Figure 15B:
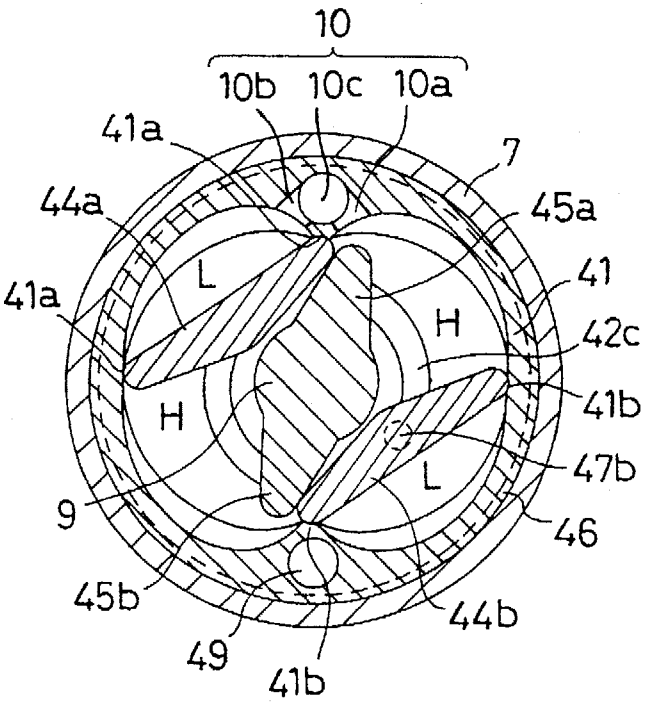
FIGS. 15(*a*)–15(*b*) show a fourth embodiment of the impulse torque generator of the present invention, FIG. 15(*a*) is an elevation view of the impulse generator and FIG. 15(*b*) is a cross sectional view taken along line IV—IV of FIG. 15(*a*).
Figure 15A:
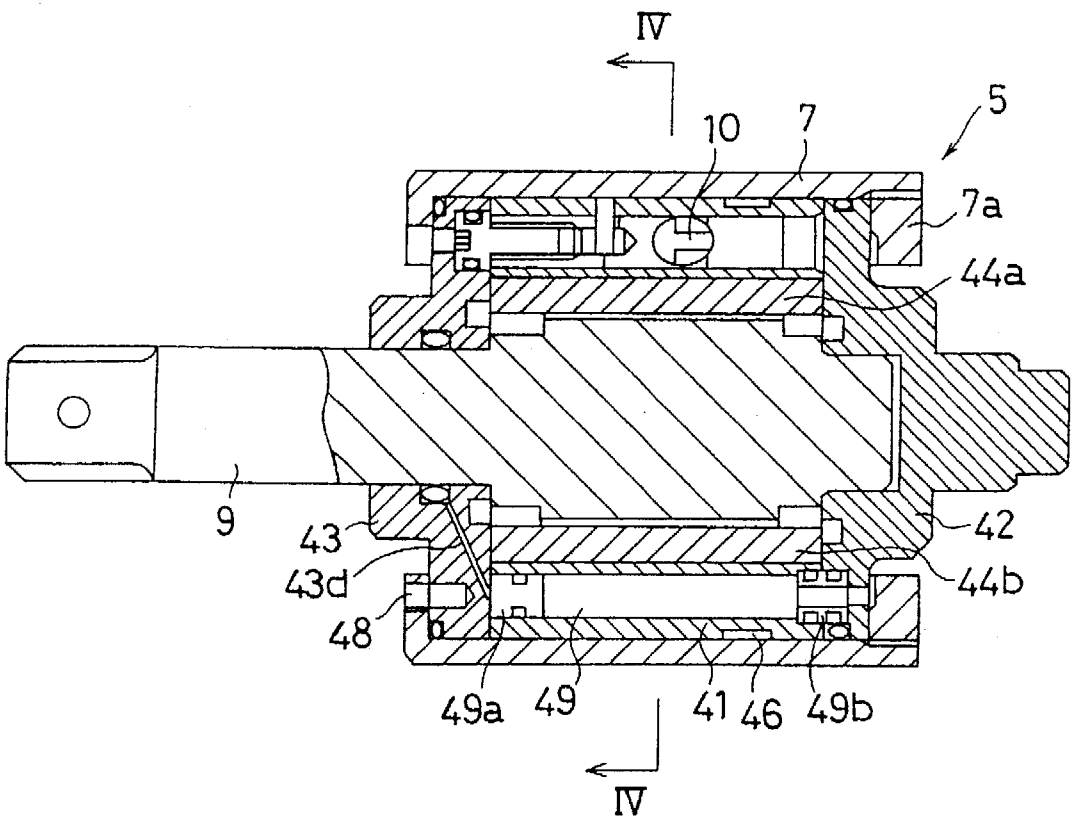

The third embodiment of the present invention is illustrated in FIGS. 13(*a*)–13(*b*) and FIGS. 14(*a*)–14(*d*).

The basic structure of the third embodiment is the same as the first embodiment described above.

An impulse generator, filled with hydraulic oil, is disposed inside a liner case 7, and a main shaft 9 is coaxially mounted in the liner 31.

The liner 31 has an oval profile internal cavity section and two pairs of sealing surfaces 31*a*, 31*b* are provided on an internal peripheral surface of the liner 31. The sealing surfaces 31*a*, 31*b* are smoothly contoured and are not arranged symmetrically with respect to the center of the revolution at an angle of 180 degrees.

The cylindrical liner 31 is inserted inside the liner case 7 and the ends of the liner 31 are covered with an upper cover 32 and a lower cover 33 which are secured to the liner 31 with knock-pins 37 inserted into pin holes 32*a*, 33*a*. The assembled liner and covers are thereby rotatable as a solid body. Further, the upper cover 32 is covered with a liner case cover 7*a* for fixing the cover in the axial direction and for sealing the hydraulic oil inside of the liner 31.

A main shaft 9, mounted inside of the liner 31, has two smoothly contoured projections 35*a*, 35*b* symmetrically disposed with respect to the revolution center by an angle of 180 degrees. The radial length and the axial length of the two projections 35*a*, 35*b* are smaller than that of the liner, thereby forming hydraulic oil passages between the driving blades and both ends of the liner 31, and between the top of the projections 35*a*~,35*b* and the inner surface of the liner 31.

Two driving blades 34*a*, 34*b*, having a triangle shape with smooth contours and of different size, are inserted inside the liner cavity and are separated by projections 35*a*, 35*b* of the main shaft 9. The driving blade 34*a* is larger than the other driving blade 34*b*. The axial length of the driving blades 34*a*, 34*b* are the same as the axial length of the inner cavity of the liner so that the driving blades contact the upper cover and the lower cover at both ends. Sealing surfaces 34*a*, 34*b* are provided at both ends of the driving blades. The sealing surfaces of the driving blades 34*a*, 34*b* meet and contact with the sealing surfaces 31*a*, 31*b* of the liner to form a seal one time with each revolution of the liner 31.

In this embodiment, two pairs of 4 sealing surfaces 31*a*, 31*b* are not disposed symmetrically with respect to the center of revolution around the inner surface of the liner 31 at an angle of 180 degrees and driving blades of different size are inserted in the liner 31. The seal surfaces 31*a*, 31*b* and the seal surfaces of the driving blades 34*a*, 34*b* meet only one time with each revolution of the liner 31 and one impulse is generated on the main shaft 9. Instead of adapting the different sized driving blades, it is possible to generate one impulse during one revolution by adapting a symmetrically disposed crank-like shaped sealing surface along the driving blade, an inclined sealing surface along the driving blade, or a V-shaped seal surface.

A passage 36 is disposed in an outer surface of the liner 31, and communicates with low pressure chambers L which are formed inside the liner cavity by the driving blades 34*a*, 34*b*. An output adjusting mechanism is disposed in the liner parallel to the axis of the liner 31. This mechanism is a well known mechanism and may comprise ports 10*a*, 10*b* which connect high pressure chambers H and an output adjusting valve 10*c* screwed into a screw hole 33*b* in the lower cover 33.

In this embodiment, the impulse torque generator includes sealing surfaces 31*a*, 31*b*, which are two pairs of sealing surfaces disposed on the internal peripheral surface of the liner 31, two projections 35*a*, 35*b* radially projecting from the main shaft 9, and two driving blades 34*a*, 34*b*. But the number of the sealing surfaces is not restricted to this number. The number of the seal surfaces are selected depending on the desired strength of the impulse generated during each revolution of the liner. For instance, if there is provided more than n (n is greater than 3) pairs of sealing surfaces around the inner surface of the liner, then it will be necessary to provide n projections radially projecting from the main shaft and n driving blades, and consequently, a greater impulse is generated.

Now, the process of generating an impulse is explained in more detail with reference to FIGS. 14(*a*)–14(*d*).

The rotor 4 is actuated by introducing compressed air into the rotor 4 of the main body by opening the main valve 2 and the switch valve 3. The revolution power is transmitted to the liner 21. As the liner rotates, the orientation of the inside the liner case 7 changes as shown in FIGS. 14 (*a*)–(*b*)–(*c*)–(*d*)–(*a*). FIG. 14(*a*) shows the position in which no impulse is generated on the main shaft 9. FIGS. 14(*b*), (*c*), (*d*) indicate positions of the liner 31 rotated about an angle of 90 degrees respectively.

An impulse is generated, as shown in FIG. 14(*b*), when the sealing surfaces 31*a*, 31*b* and the sealing surfaces of the driving blades 34*a*, 34*b* meet together and the inner cavity of the liner 31 is divided into four chambers. The instant an impulse torque is generated on the main shaft 9, the volume of a high pressure chamber H decreases and the volume of a low pressure chamber L increases because of the shape of the inner surface of the liner. The high pressure chambers are then changed to low pressure chambers and vise versa. That is, as the rotor drives the liner 31, sealing surfaces 31*a*, 31*b* of the liner meet the sealing surfaces of the driving blades 34*a*, 34*b*, and each chamber becomes a high pressure chamber or a low pressure chamber. Then the driving blades 24*a*, 24*b* are pushed toward the low pressure chambers, and the sealing surfaces have completely sealed and the rotational power of the liner 31 is exerted on a projections 35*a*, 35*b* of the main shaft 9 through the driving blades 34*a*, 34*b*. Accordingly, an impulse is provided on the main shaft 9, which represents one impulse with each revolution of the liner for tightening or loosening bolts or nuts.

In the position shown in FIG. 14(*a*), the instant the sealing surfaces 31*a*, 31*b* of the liner 31 meet the sealing surfaces of the driving blades 34*a*, 34*b*, each chamber becomes a high pressure chamber H or a low pressure chamber L for a very short period, and then the driving blades are pushed toward the low pressure chamber. The seal between the sealing surfaces of the liner and the driving blades are broken, and hydraulic oil starts to flow from the high pressure chamber to the low pressure chamber through the broken seal and no impulse is generated on the main.shaft 9 at this stage.

In FIGS. 14(*c*) and (*d*), the sealing surfaces of the liner 31 never meet the sealing surfaces of the driving blades because of the asymmetrical layout of the sealing surfaces 31*b*, 31*a* and the different sized driving blades, and therefore no impulse is generated during this stage.

If the rotor 4 is driven in a reverse direction, the orientation of the liner will change in the reverse direction of FIG. 14, that is, the state of the inside of the liner changes as FIGS. 14(*d*)–(*c*)–(*b*)–(*a*)–(*d*) and a reverse direction impulse on the main shaft is generated.

The fourth embodiment of the invention is shown in FIG. 15 to FIG. 20.

The basic structure of the fourth embodiment is same as the first embodiment explained before.

An impulse generator, filled with hydraulic oil, is disposed inside a liner case 7, and a main shaft 9 is coaxially mounted through the center of liner 41.

The liner 41 has an oval profile internal cavity section and two pairs or four sealing surfaces, 41*a*, 41*b* are provided. The sealing surfaces project from the inner surface of the liner and are arranged symmetrically with respect to a center of the revolution at an angle of 180 degrees.

The cylindrical liner 41 is inserted inside the liner case 7 and the ends of the liner case 7 are covered with an upper cover 42 and a lower cover 43 which are secured to the liner 41 with knock-pins (not shown) inserted into pin holes 42*a*, 43*a*. The assembled body is thereby rotatable as a solid body. Further, the upper cover 42 is covered with liner case cover 7*a* for fixing the cover in the axial direction and to seal the hydraulic oil inside the liner 41.

Figure 18A:
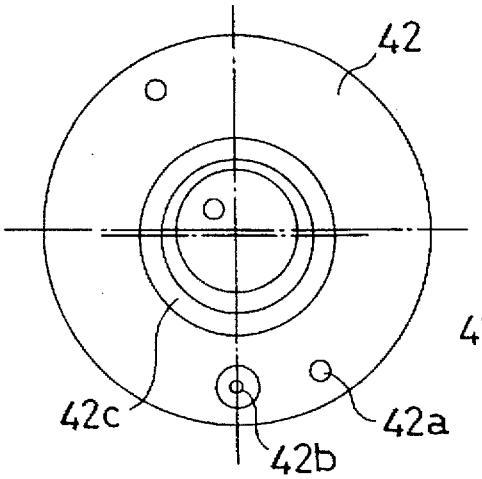
FIGS. 18(*a*)–18(*b*) show an upper cover of the liner of the impulse generator of the fourth embodiment.
Figure 18B:
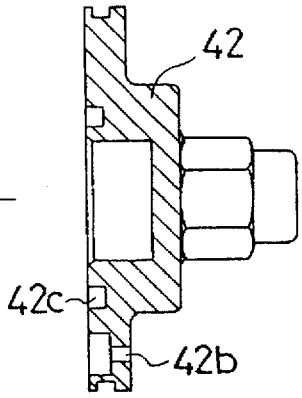
Figure 19A:
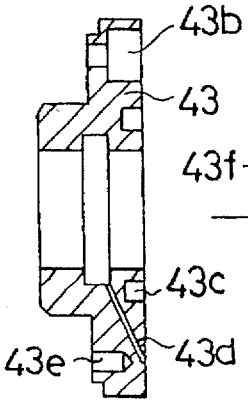
FIGS. 19(*a*)–19(*b*) show a lower cover of the liner of the impulse generator of the fourth embodiment.
Figure 19B:
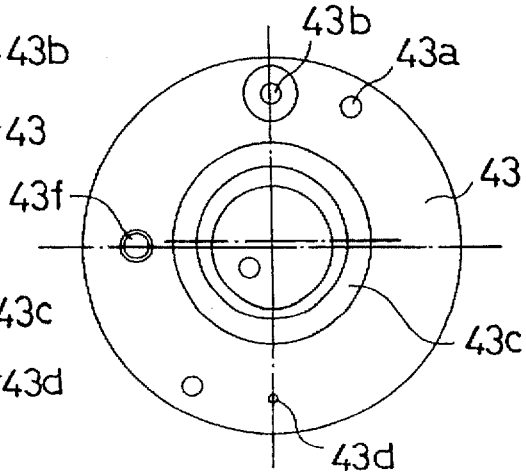
Figure 20A:
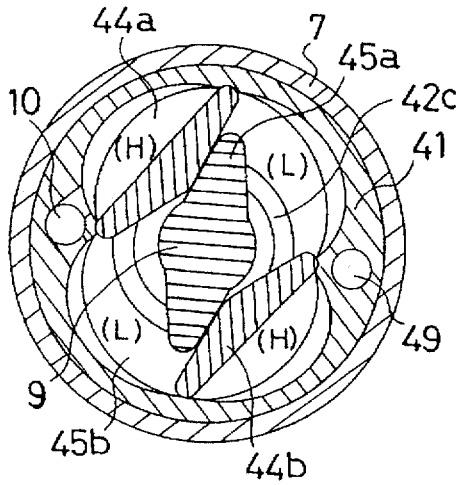
FIGS. 20(*a*)–20(*d*) show an impulse generating process of the impulse generator of the fourth embodiment.
Figure 20B:
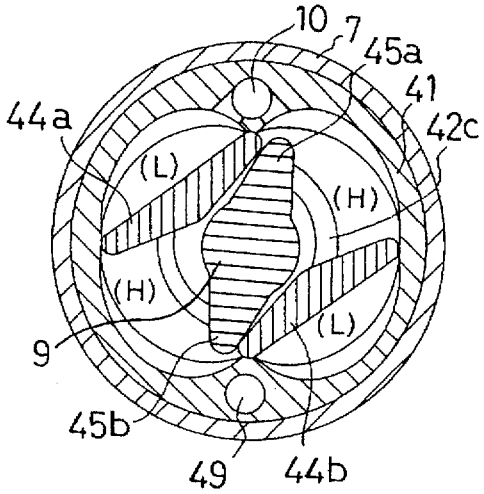
Figure 20C:
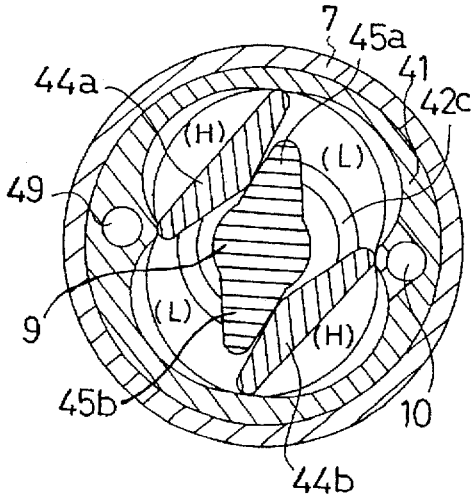
Figure 20D:
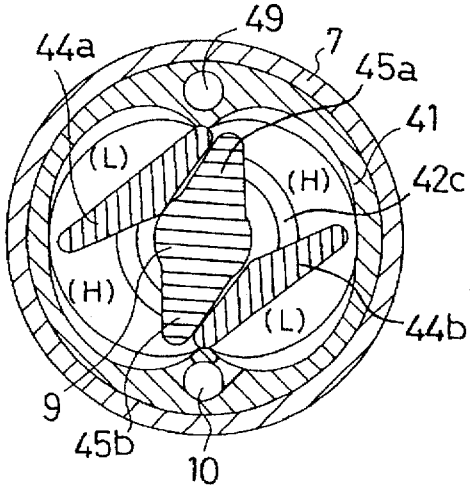

Guide grooves 42*c*, 43*c* are provided on the surface of the upper cover 42 and the lower cover 43. As shown in FIG. 18 and FIG. 19, the guide grooves 42*c*, 43*c* are eccentrically disposed with respect to the revolution center of the liner, and the direction of the eccentricity of the two guide grooves is in a 180 degree opposite direction.

Also, a hole 43*e* and an oil inlet 43*f* are provided in the lower cover 43. A pin 48 is inserted in the hole 43*e* for fixing the cover to the liner cover and to prevent rotation of the lower cover 43 with respect to the liner case 7. This construction is also applicable to the previously described embodiments of the present invention.

A main shaft 9 is mounted inside the liner 41 and has two smooth shaped projections 45*a*, 45*b* symmetrically disposed with respect to the revolution center by an angle of 180 degrees. The radial length and the axial length of the two projections 45*a*, 45*b* are smaller than that of the liner thereby forming hydraulic oil passages at both ends of the liner and between the top of the projections and the inner surface of the liner.

Two same-size driving blades 44*a*, 44*b* of triangle shape with smooth contours are inserted inside of the liner cavity and are separated by projections 45*a*, 45*b* of the main shaft.

The axial length of the driving blades is the same as that of the inner cavity of the liner so that the driving blades contact both the upper cover and the lower cover at their ends.

Figure 16A:
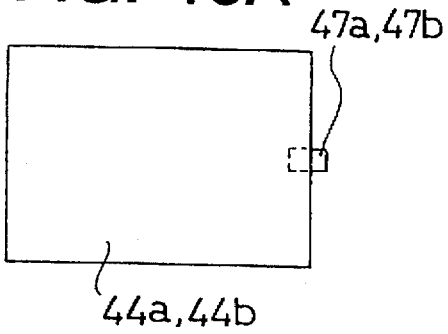
FIGS. 16(*a*)–16(*b*) show a driving blade of the impulse generator of the fourth embodiment.
Figure 16B:
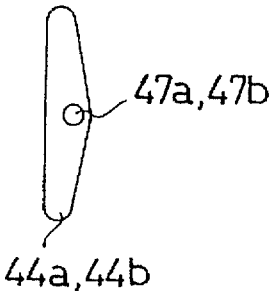
Figure 17A:
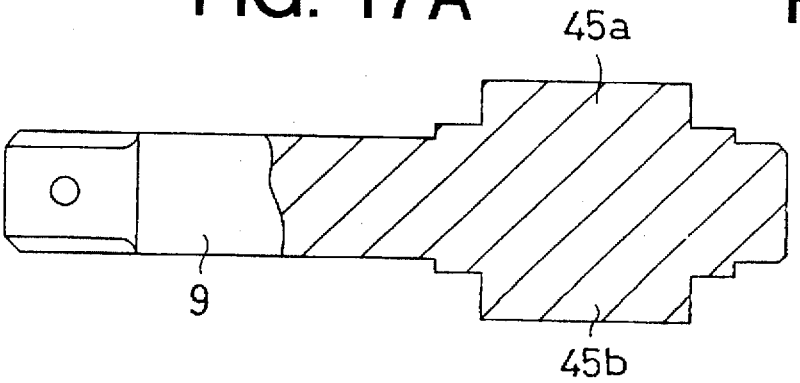
FIGS. 17(*a*)–17(*b*) show a main shaft of the fourth embodiment.
Figure 17B:
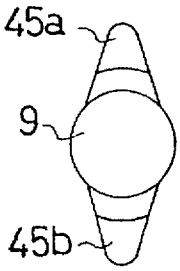

Both radial ends of the driving blades 44*a*, 44*b* are formed with sealing surfaces for contacting the sealing surfaces of the liner 41. As shown in FIG. 16, guide pins 47*a*, 47*b*, are inserted in the guide grooves 42*c*, 43*c* at either one of the longitudinal ends of the driving blades 44*a*, 44*b*. More specifically, the guide pin 47*b* is inserted in the guide groove 42*c* guide pin 47*a* in the guide groove 43*c*. As the guide grooves 42*c*, 43*c* are disposed eccentrically with respect to the center of the revolution, the sealing surfaces of the liner and driving blades meet two times during each revolution of the liner, but the motion of the driving blade is limited by the guide grooves, and therefore an impulse is generated at every other meeting. Therefore, only one impulse is generated with each revolution of the liner.

A passage 46 is disposed in an outer surface of the liner 41. The passage ditch 46 connects low pressure chambers L which are formed inside the liner cavity by the driving blades 44*a*, 44*b*. An output adjusting mechanism is disposed in the liner parallel to the axis of the liner 41. This mechanism is a well known mechanism, and may include ports 10*a*, 10*b* which communicate with high pressure chambers H, formed inside the liner cavity by the driving blades 44*a*, 44*b*, and an output adjusting valve 10*c* which is screwed into a screw hole 43*b* disposed in the lower cover 43.

An accumulator 49 for absorbing the heat expansion of the hydraulic oil is disposed parallel to the axis of the liner 41. The accumulator 49 includes a piston 49*a*, and an air permeable member 49*b* in which one end of the accumulator 49 is connected to the inner cavity of the liner 41 via a small passage 43*d* disposed in the lower cover 43 of the liner. The other end is connected to the open air through the air permeable member 49*b*. A small hole 42*b* is disposed in the upper cover 43 and a gap is provided between the upper cover 42 and the liner case 7*a*.

In this embodiment, the impulse torque generator includes four sealing surfaces 41*a*, 41*b*, which are two pairs of sealing surfaces disposed inside the liner 41, two projections 45*a*, 45*b* radially projecting from the main shaft 9, and two driving blades 44*a*, 44*b*. The number of sealing surfaces is not restricted to this number. The number of the seal surfaces is selected depending on the desired strength of the impulse generated during one revolution of the liner. For instance, if there is provided more than n (n is greater than 3) pairs of sealing surfaces around the inner surface of the liner, then n projections radially projecting from the main shaft and n driving blades are necessary and will result in the generation of a greater impulse.

It is possible to generate one impulse by eccentrically disposing a proper shape and a proper number of guide grooves on the upper and the lower cover of the liner.

Now, the process of generating an impulse is described in more detail with reference to FIG. 20.

The rotor 4 is actuated by introducing compressed air into the rotor 4 of the main body by opening the main valve 2 and the switch valve 3. The revolution power is transmitted to the liner 41. As the liner rotates, the orientation of the inside the liner case 7 changes as indicated in FIGS. 20 (*a*)–(*b*)–(*c*)–(*d*)–(*a*). FIG. 20(*a*) shows the state where no impulse is generated on the main shaft 9. FIGS. 20(*b*), (*c*), (*d*) show the liner 41 rotated about an angle of 90 degrees respectively.

An impulse is generated as indicated in FIG. 20(*b*) when the sealing surfaces 41*a*, 41*b* and the sealing surfaces of the driving blades 44*a*, 44*b* meet together and the inner cavity of the liner 41 is divided into four chambers. The instant an impulse torque is generated on the main shaft 9, the volume of a high pressure chamber H decreases and the volume of a low pressure chamber L increases because of the shape of the inner cavity of the liner 41. The high pressure chamber changes to a low pressure chamber and vise versa. That is, as the rotor 4 drives the liner 41, sealing surfaces 41*a*, 41*b* of the liner meet the sealing surfaces of the driving blades 44*a*, 44*b*, and each chamber becomes a high pressure chamber or a low pressure chamber. The driving blades 44*a*, 44*b* are pushed toward the low pressure chamber, and the sealing surfaces have completely sealed and thereby the rotational power of the liner 41 is exerted on projections 45*a*, 45*b* of the main shaft 9 through the driving blade 44*a*, 44*b*. An impulse is provided on the main shaft 9 intermittently, which is one impulse with one revolution of the liner for tightening or loosening of bolts or nuts.

In the position shown in FIG. 20(*d*), when the sealing surfaces 41*a*, 41*b* of the liner 41 and the sealing surfaces of the driving blades almost meet, the guide pins 47*a*, 47*b* of the driving blades, inserted in the eccentric guide grooves 42*c*, 43*c*, limit movement of the driving blades. Therefore, the sealing between the liner and the driving blades is not completely achieved and an impulse is not generated on the main shaft 9.

As indicated in FIGS. 20(*a*) and (*c*), the liner rotates and sealing surfaces 41*a*, 41*b* of the liner and the sealing surfaces of the driving blade meet, each chamber becomes a high pressure or a low pressure chamber, and the driving blades are pushed toward the low pressure chamber. Then the seals formed between the sealing surfaces are broken and the hydraulic compressed oil in the high pressure chambers flows out through gaps between the sealing surfaces into a low pressure chamber, and therefore no impulse is generated on the main shaft.

If the rotor 4 is driven in a reverse direction, the liner case 7 will change in the reverse direction of FIG. 20, that is, the orientation of the inside of the liner changes as shown in FIGS. 20(*d*)–(*c*)–(*b*)–(*a*)–(*d*), and a reverse direction impulse on the main shaft 9 is generated.

What I claim is:

1. An impulse torque generator for a hydraulic power driven wrench, said impulse torque generator comprising:

a rotor;

a liner, operatively connected to said rotor, having a first end, a second end, and at least two pairs of sealing surfaces spaced about an inner peripheral surface of said liner, wherein said liner defines a hydraulic fluid cavity;

a main shaft rotatably and coaxially mounted within said liner, and having at least two projections; and at least two driving blades mounted within said liner, and having a first longitudinal edge portion and a second longitudinal edge portion, respectively, wherein said first longitudinal edge portion and said second longitudinal edge portion of said respective driving blades form sealing surfaces which, upon mating with one of said pair of sealing surfaces on said liner, form high pressure and low pressure chambers and the pressure in the high pressure chamber acts on one of said main shaft projections through said driving blade to impart an impulse torque to said main shaft.

2. The impulse torque generator as claimed in claim 1, wherein said liner has a center of rotation and said at least two pairs of seal surfaces on said liner are symmetrically positioned on said liner by an angle of rotation of 360/n degrees, where n is the number of pairs of seal surfaces on said liner, about said center of rotation to thereby generate n impulses with each revolution of said liner.

3. The impulse torque generator as claimed in claim 1, further comprising:

a first cover having a groove formed in an inner surface of said first cover and being connected to said first end of said liner; and a second cover connected to said second end of said liner;

a groove provided in an end of each of said driving blades corresponding to said first cover, wherein said liner has a center of rotation and said at least two pairs of seal surfaces on said liner are symmetrically positioned on said liner by an angle of rotation of 360/n degrees, where n is the number of pairs of seal surfaces on said liner, about said center of rotation, and said groove in said first liner cover and said grooves in said corresponding end surfaces of said driving blades, communicate during rotation of liner to release hydraulic fluid pressure, and one impulse is generated with each revolution of said liner.

4. The impulse generator as claimed in claim 1, wherein said liner has a center of rotation and said at least two pairs of seal surfaces on said liner are spaced on said liner by an angle of rotation of 360/n degrees, where n is the number of pairs of seal surfaces on said liner, about said center of rotation and said at least two pairs of seal surfaces are not symmetric with respect to said center of rotation to thereby generate one impulse with each revolution of said liner.

5. The impulse generator as claimed in claim 1, further comprising:

a first cover connected to said first end of said liner and having an eccentric guide groove formed in an inner surface of said first cover;

a second cover connected to said second end of said liner and having an eccentric guide groove formed in an inner surface of said second cover;

a first guide pin provided in an end of one of said driving blades and engaging said eccentric guide groove in said first cover; and a second guide pin provided in an end of another of said driving blades and engaging said eccentric guide groove in said second cover;

wherein said liner has a center of rotation and said at least two pairs of seal surfaces on said liner are symmetrically positioned on said liner by an angle of rotation of 360/n degrees, where n is the number of pairs of seal surfaces on said liner, about said center of rotation to thereby generate one impulse with each revolution of said liner.

* * * * *